US006529142B2

(12) United States Patent
Yeh et al.

(10) Patent No.: US 6,529,142 B2
(45) Date of Patent: Mar. 4, 2003

(54) PARKED VEHICLE LOCATION FINDER

(76) Inventors: Shipong Norman Yeh, 2037 Dawn St., Lomita, CA (US) 90717; Hen-Geul Yeh, 4865 Linaro Dr., Cypress, CA (US) 90630

( * ) Notice: Subject to any disclaimer, the term of this patent is extended or adjusted under 35 U.S.C. 154(b) by 0 days.

(21) Appl. No.: 09/911,922

(22) Filed: Jul. 24, 2001

(65) Prior Publication Data

US 2002/0008614 A1 Jan. 24, 2002

Related U.S. Application Data

(60) Provisional application No. 60/220,408, filed on Jul. 24, 2000.

(51) Int. Cl.[7] ..... G08G 1/123
(52) U.S. Cl. ..... 340/988; 340/425.5; 340/426
(58) Field of Search ..... 340/988, 425.5, 340/426, 539; 342/357.07

(56) References Cited

U.S. PATENT DOCUMENTS 5,786,758 A * 7/1998 Bullock ..... 116/202
5,914,675 A * 6/1999 Tognazzini ..... 340/426
6,246,314 B1 * 6/2001 Djaid ..... 340/425.5
6,346,878 B1 * 2/2002 Pohlman et al. ..... 340/10.1
6,363,324 B1 * 3/2002 Hildebrant ..... 342/357.08
6,392,592 B1 * 5/2002 Johnson et al. ..... 340/426
6,407,698 B1 * 6/2002 Ayed ..... 29/4.6
6,429,791 B2 * 8/2002 Quinn ..... 340/932.2

* cited by examiner

*Primary Examiner*—John Tweel
(74) *Attorney, Agent, or Firm*—Monty Koslover

(57) ABSTRACT

A system for locating a vehicle that is parked in a parking lot, a parking garage or on a street. The system comprises two separate signal generator/processor circuits, each circuit being contained in a module, one being a hand-held locator module and the other, a receive/response module that is installed in a vehicle. Both modules, when activated by user, communicate with the other by means of specially encoded radio signals. To find a parked vehicle, a user merely presses a pushbutton on the locator module which transmits a high frequency search signal. In response, the receive/response module emits a direction indicating signal to the locator module, which then displays the direction and elevation of the vehicle with respect to the user location. Provision is made for the receive/response module to operate without a connection to a vehicle battery if necessary, allowing the module to be used portably. The system is small in size, inexpensive and easy to use.

5 Claims, 4 Drawing Sheets

SIGNAL TO NOISE RATIO AT BASEBAND
VS.
VARIANCE OF AOA ESTIMATOR

| SNR (dB) | VARIANCE (deg) |
|---|---|
| 2 | 13 |
| 3 | 6 |
| 6 | 2 |

PARKED VEHICLE LOCATION FINDER

This application claims the benefit of U.S. Provisional Application No. 60/220,408 filed Jul. 24, 2000.

BACKGROUND OF THE INVENTION

1. Field of the Invention

This invention relates generally to devices and systems which aid in the location of a parked automobile in crowded parking lots or on streets.

2. Background

Searching for a parked automobile, whether in a large parking lot or in a parking garage, is a commonplace daily event in large U.S. cities and suburban areas. Searchers often may wander about for some time until they spot the vehicle. This practice is usually frustrating, and depending on the time of day and the location, may even be dangerous. Therefore, most people try to come up with some way of remembering and identifying exactly where an automobile was parked. Further, many of the automobiles and SUV's in today's parking lots look alike, which exacerbates the difficulties of a straight forward sighting.

A number of invention devices have become available, offering a solution to this common daily problem. These include various projections that are fastened to the tops of automobiles, and which may light up or emit a sound upon receiving a radioed activating signal. However, for a number of reasons including cost, the devices do not appear to be favored by the public, as a trip to mall parking lots will verify. There therefore remains a need for a simple, practical, inexpensive system for locating a parked vehicle in a large parking lot or parking garage.

SUMMARY OF THE INVENTION

The present invention provides a system comprising a direction indicating device and omni-directional radio signal generator packaged in a small, hand-held locator module, and a vehicle mounted receive/response module that interacts with the locator module. The hand-held locator module is used to generate and transmit a high frequency radio signal which is received by a small directional antenna array in the vehicle receive/response module. Means are provided in the receive/response module to compute the entry angle of the received radio signal at the vehicle, and to transmit a new signal to the locator module which processes the new signal and displays the direction of the vehicle location with respect to the axis of the hand-held locator module.

The invention devices use primarily, small, standard low cost parts, requiring little power and operating efficiently.

Accordingly, it is a principal object of this invention to provide a parked vehicle location finder system that is inexpensive and easy to use.

Another object is to provide a parked vehicle location finder that can be easily adapted to any automobile.

An advantage of this invention is that the finder indicates the vehicle elevation in addition to its planar direction.

Further objects and advantages of the invention will be apparent from studying the following portion of the specification, the claims and the attached drawings.

DESCRIPTION OF THE PREFERRED EMBODIMENT

The invention is a system for locating a vehicle that may be parked in a parking lot, a parking garage or on a nearby street. The system comprises two modules: a hand-held locator module 1 and a vehicle-mounted receive/response module 40; both modules when activated, communicating with the other by means of specially encoded radio signals.

Figure 1:
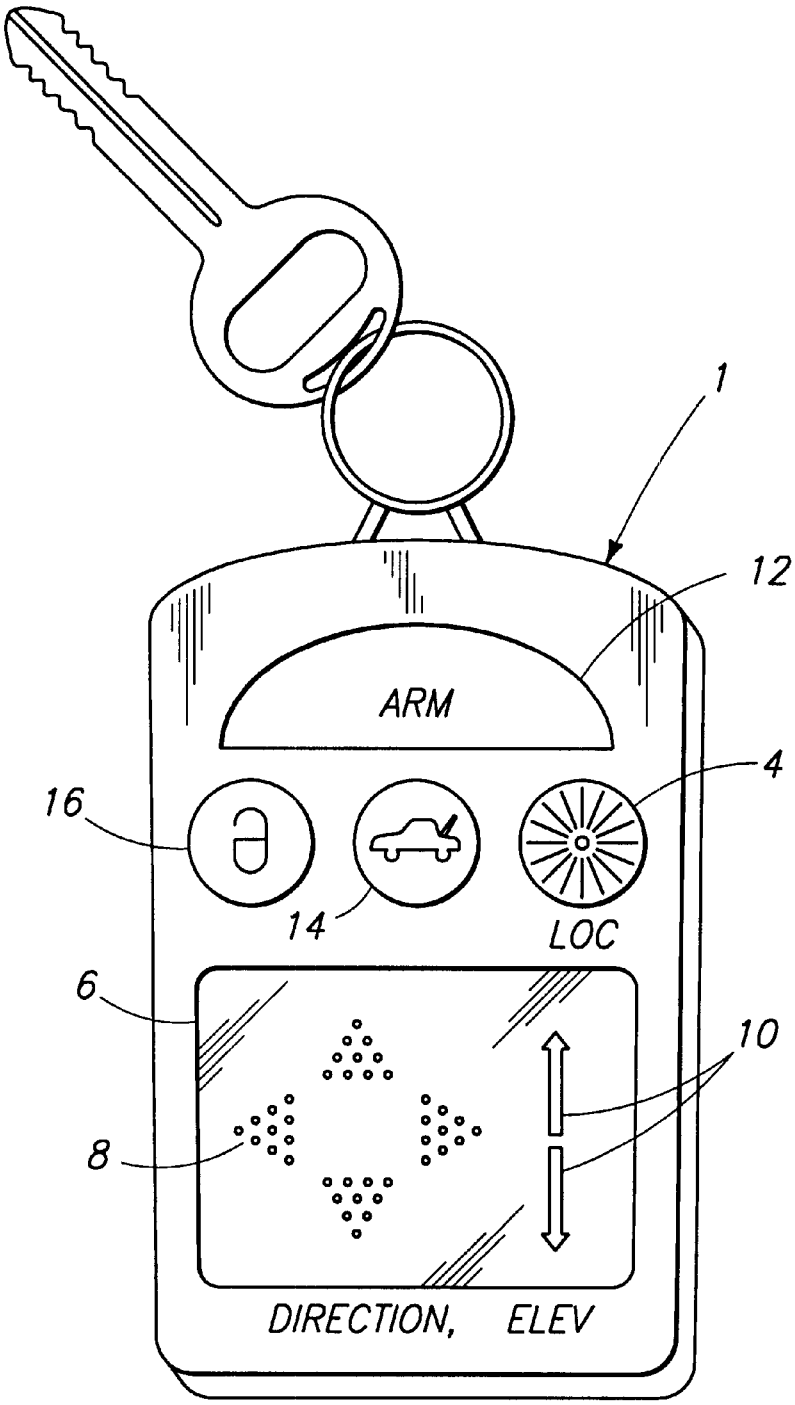
FIG. 1 is a front view of a hand-held vehicle locator module according to the present invention, particularly showing the locator activation pushbutton switch and display, and also showing non-invention typical keyless-entry push-button switches that may share the locator module space.

Referring-particularly to the drawings, there is shown in FIG. 1 a front perspective view of the present invention locator module 1. The locator module 1 case is about the same size and shape as those used as keyless entry devices for cars, and has a substantial amount of internal unused volume and surface area. As a convenience, some keyless entry functions may be combined with the locator functions. Therefore, three typical keyless entry push-buttons are illustrated. These are an arm/disarm button 12, a trunk opener button 14, and an unlock button 16. However, it should be noted that the keyless entry functions are not part of this invention and need not be included in the locator module.

The prime function of the locator module 1 is finding the location of a parked vehicle, which is performed simply by depressing a button switch marked "LOC" 4 and observing the display 6 on the module case. The LOC button 4, once pressed, causes the module to transmit a high frequency search signal of approximately 930 MHz covering the area where the parked vehicle is located. A present invention receive/response module 40 that is mounted in the vehicle, receives the search signal and transmits a direction indicating signal to the locator module 1, causing one of the display direction arrows 8 to light up in the direction of the vehicle. If the vehicle is parked at a higher or lower elevation than where the user stands, one of the two display elevation arrows 10 will light up, pointing up or down. The user merely walks in the direction of the lit arrows. If he or she passes the vehicle, the arrows will redirect by switching directions.

Figure 2:
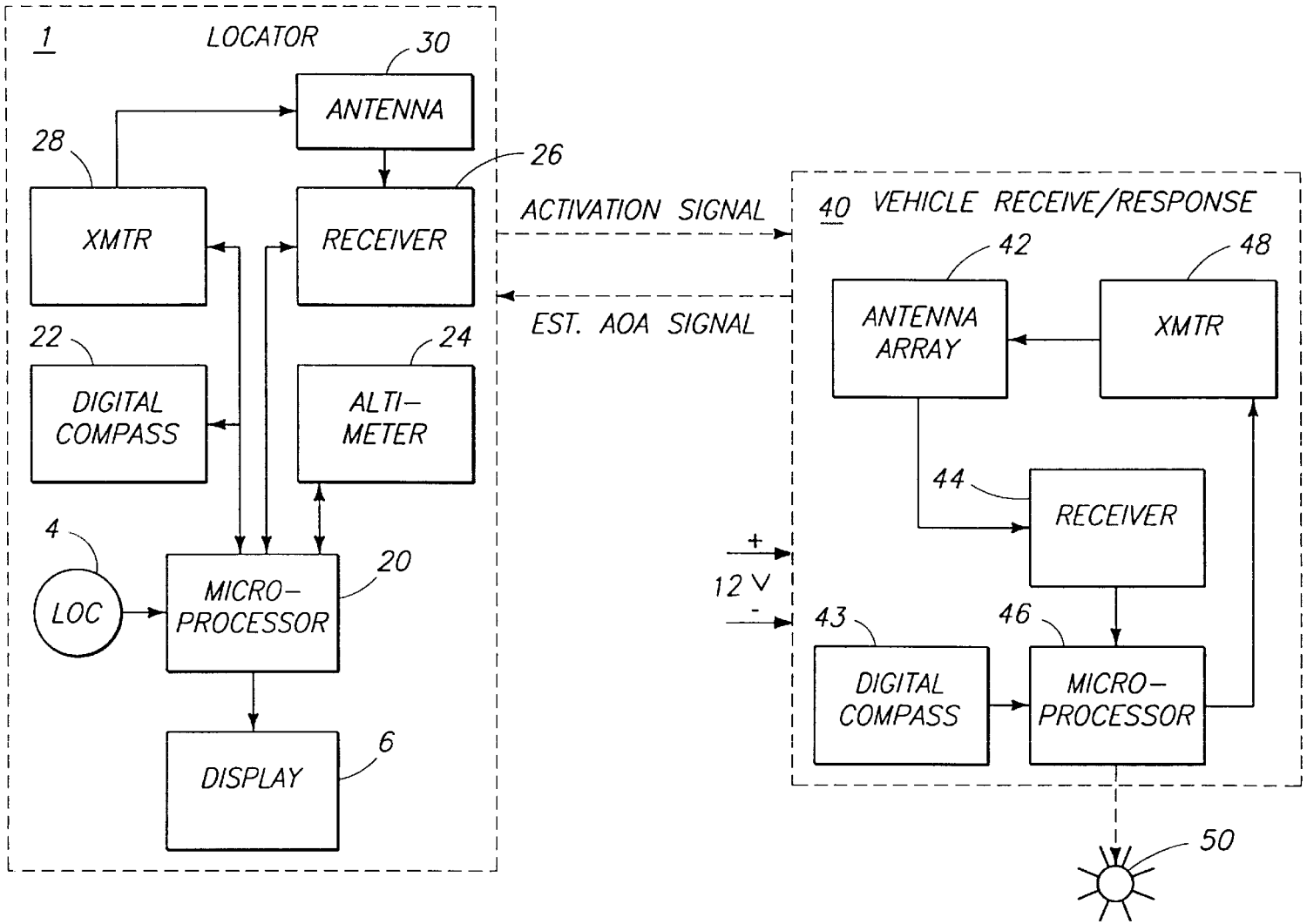
FIG. 2 is a simplified block diagram of the present invention system module circuits, particularly indicating an activation signal emitted by the locator module and the response signal of the vehicle mounted receive/response module.
Figure 3:
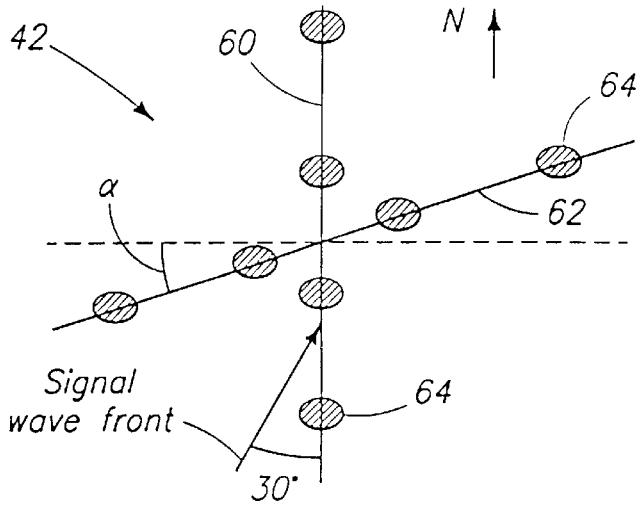
FIG. 3 is a representation of a two-dimensional multiple element array antenna that is part of the vehicle receive/response module according to the present invention, particularly showing vertical and tilt-horizontal antenna arrays and the angle of a test simulation incoming signal wave front that was emitted by the locator module.

Refer now to FIG. 2 which is a simplified system block diagram of the invention module circuits, and to FIG. 3 which is a representation of the directional antenna 42 that is part of the vehicle receive/response module 40. The locator module 1 circuit comprises the following elements: a locator activation pushbutton 4 and circuit, a direction indicator visual display 6 and driver circuit, a programmable microprocessor 20, a digital compass 22, an altimeter 24, a receiver 26, a signal transmitter 28, an omni-directional antenna 30, and a 12 vdc battery power supply.

The microprocessor 20 is programmed as follows: (a), to generate and initiate an encoded search signal transmission upon demand; (b), to activate and read the digital compass 22 and altimeter 24; and (c), to process incoming direction indicating digital signals from the receiver 26 and send the resulting direction signals to a display driver for illuminating the direction indicators on the visual display 6.

The vehicle receive/response module 40 comprises the following:

(a) a rigid, rectangular shaped, closed case with two planar opposing sides, including an input power connector fastened to one side; and, (b) a receive/response circuit that is housed in the case.

The circuit comprises the following elements: an adaptive antenna array 42, a digital compass 43, a receiver 44, a microprocessor 46, a signal transmitter 48, and an input power voltage regulator circuit that is connected to an input 12 vdc power connector which is mounted externally on the module case. The circuit may also include an external flashing indicator light 50 that is activated by closure of a switch initiated by a microprocessor 46 signal, and is mounted on top of the vehicle.

The vehicle receive/response vehicle module 40 circuitry is normally powered by the vehicle 12 vdc battery, to which it is connected when installed. As an option, the module 40 may instead contain its own rechargeable 12 vdc battery power source and charger circuit.

As shown in FIG. 3, the adaptive antenna array 42 comprises two independent linear arrays 60, 62, with each independent array having multiple elements 64. The array geometry is a two-dimensional cross shape, with one linear array 60 designated as "vertical" and the other linear array 62 designated as "horizontal". For optimum operation, the horizontal array 62 is tilted alpha degrees counter-clockwise around the center of the vertical array. The value of alpha is typically about 30 degrees, but may be varied somewhat to suit a particular placement in a vehicle.

The "N" (North) arrow reference shown in the drawing is only a reference for the vertical array direction, which may be actually pointed in any compass direction. When in use, the north direction with respect to the vertical array, is determined by the digital compass 43 contained in the receive/response module 40.

The adaptive antenna array 42 which is depicted in FIG. 3 is particularly designed for narrowband wireless object location. Also, a choice of a high frequency signal transmission such as at 930 MHz, results in a very small size planar antenna array. The array can then be easily packaged in a small, thin module together with a module circuit board, and mounted unobtrusively inside a vehicle. This aspect presents a considerable advantage over currently available vehicle locator systems and devices.

The microprocessor 46 is a digital signal processor (DSP) which is programmed to process a received search signal, determine the entry angle of the signal at the antenna relative to true north, and to generate a new indicating signal for transmission to the user's locator module.

Two independent algorithms are used by the processor to compute the received antenna signal patterns and determine the signal entry angle of arrival (AOA). These algorithms are part of a special coded software program for this invention, which is considered to be integral with and a vital part of this invention. A separate patent application for this software, referencing this invention, is being considered for filing at an early date.

In brief, the combined algorithm steps are as follows:

1. Calculate the estimated AOA (angle of arrival) with respect to the vertical antenna axis, theta_V2, and to its' image, theta_V1.
2. Calculate the estimated AOA with respect to the horizontal antenna axis, theta_H2, and to its' image, theta_H1.
3. Compensate the estimated AOA for the tilt orientation of the horizontal array axis.
4. Select the pair which is the minimum of abs (theta_H1–theta V1) etc. for four different pair combinations of theta H1, H2, V1, V2, and take the averaged value of the selected pair as the estimated AOA with respect to the antenna.

Operation of the invention parked vehicle location finder system is described by the following sequence of events:

A. Immediately after the vehicle is stopped and parked in a parking lot, and the vehicle is locked by depressing a LOCK or ARM switch on the locator module, the vehicle's altitude is automatically measured by an altimeter in the hand-held locator module and the altitude is recorded for reference.

B. The user holding the locator module initiates a search signal to the microprocessor, which generates a specially encoded signal for the transmitter, which in turn produces a high frequency signal for transmission by the omni-directional antenna to the general area where the vehicle is parked.

C. The adaptive antenna array on the vehicle receive/response module receives the locator module transmission and passes its signals to a receiver. The receiver translates the received signals to digital and outputs the signals to the digital signal microprocessor. The microprocessor computes the AOA (incoming signal angle of arrival) with respect to true North, using two independent algorithms, one for each of the two antenna linear arrays, and compensates the antenna results for true north using inputs from the digital compass, producing an estimated AOA.

D. The microprocessor generates an encoded estimated AOA signal for the transmitter which produces a high frequency, narrow-band signal transmission for the adaptive antenna array to transmit to the locator module.

E. The hand-held locator module antenna receives the vehicle module transmission signal and passes it to the receiver which in turn, sends its digital output to the microprocessor.

F. The microprocessor reads the digital compass for the orientation of true North with respect to the present hand-held axis of the locator module, and also reads the altimeter. The microprocessor then, from the input AOA signal, computes the direction of the vehicle with respect to the present axis of the locator module, and also computes whether the vehicle is parked on a higher or lower plane than the locator module.

G. The microprocessor passes the calculated direction signals to the display driver circuit for display of the signalled vehicle direction and elevation arrows.

Of course, all the above events described in steps B through G appear to take place instantaneously. As the user moves his or her physical orientation with respect to the parked vehicle, so will the direction displayed on the module change.

A simulated test of the vehicle receive/response module circuit 40 was performed to verify correct performance. The adaptive antenna 42 was configured and set up on a two-dimensional x–y plane as shown in FIG. 3, with the vertical linear antenna pointing to true north. A simulated wave front emitted by the locator module was postulated as arriving at the antenna 42 at an input angle of 30 degrees clockwise from south, equivalent to an angle of −30 degrees counter-clockwise from south.

The response of the vertical antenna array and the tilt-horizontal array to the input simulated wave front, was then computed, based on an SNR (signal-to-noise ratio) of 6 dB at the receiver baseband.

Figure 4:
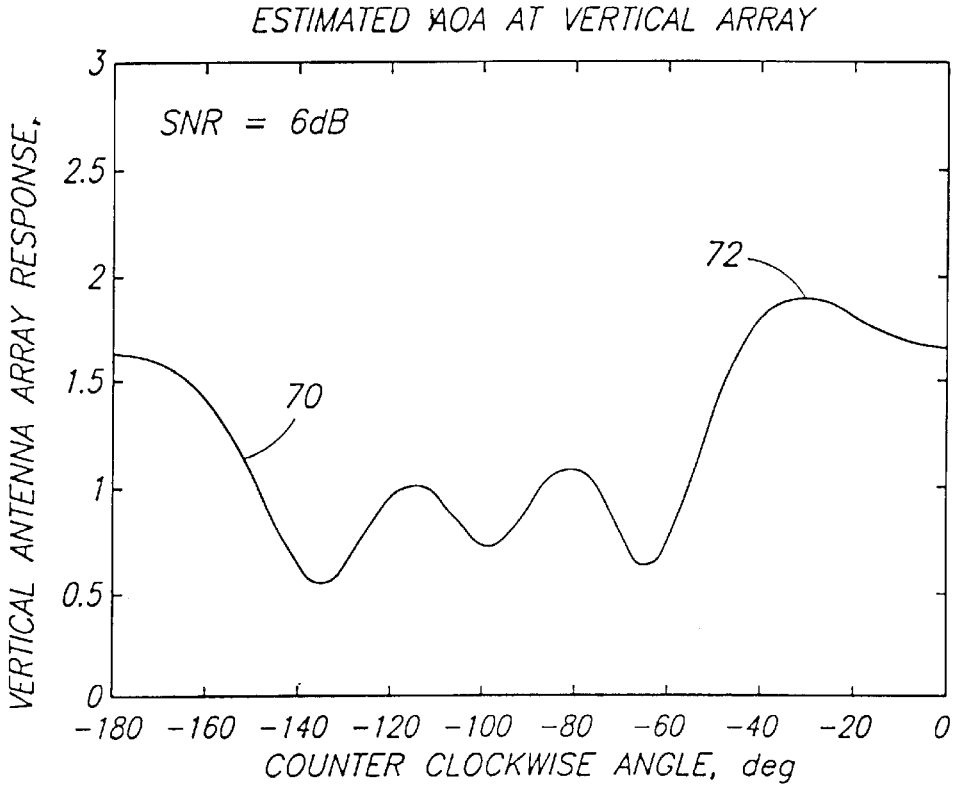
FIG. 4 is a test computed plot of the vertical antenna array response to the incoming signal wave front indicated in FIG. 3 particularly showing a peak that indicates the estimated signal angle of arrival (AOA)

FIG. 4 is a plot of the computed resulting antenna signal pattern magnitude at the vertical antenna array over the counter clockwise angles of 0 to −180 degrees. The estimated AOA, theta_V2, corresponds to the peak value 72 of the array response, i.e., theta_V2=−30 degrees.

A computation was then made to determine the complement of theta_V2, taken over the clockwise range of 0 to 180 degrees, which resulted as theta_V1=−30 degrees.

Figures 5, 6:
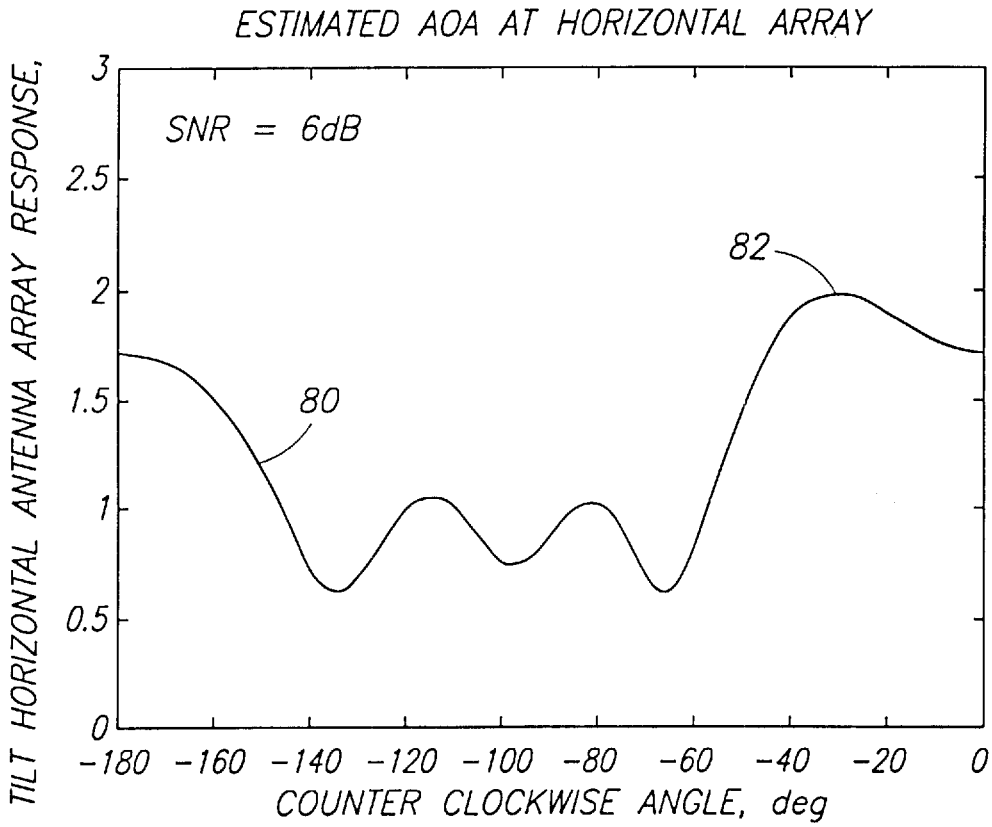
FIG. 5 is a test computed plot of the tilt-horizontal antenna array response to the test incoming signal wave front, particularly showing a peak that indicates the estimated signal angle of arrival (AOA)
FIG. 6 is a table of signal-to-noise (SNR) ratio at baseband vs. variance of the AOA estimator.

The foregoing set of computations was also performed for the signals received by the tilt-horizontal array, and FIG. 5 shows a plot of the computed resulting signal pattern at the tilt-horizontal antenna array over the counter clockwise angles of 0 to −180 degrees. The estimated AOA, theta_H2, corresponds to the peak value 82 of the array response, i.e., theta_H2=−29 degrees.

After compensating for the tilt angle orientation of the horizontal array, theta_H2 was recalculated as being −31 degrees and theta_H1=−29 degrees.

Using the above calculated values for theta_V1, V2, H1 and H2, the computed results of the applied algorithm resulted in a final estimated AOA with respect to true North=30.5 degrees. At this point, the receive/response module would have transmitted a signal to the locator module indicating an AOA of 30.5 degrees, which is quite accurate.

FIG. 6 is a table of the probable maximum variance of the AOA estimator for given levels of SNR at the receiver baseband. It is suggested that the SNR at the receiver baseband should be greater than 3 dB to obtain a reliable estimated AOA.

The power level required for signal transmission between the modules is estimated at 0.25 watt or less. This should be adequate for a search and receive radius of a quarter mile, such as might be needed for searching the parking lot of a large shopping mall. All the electrical components in the system modules, excepting the antennas, are standard available parts, with many of the subcircuits such as the altimeters, compasses, transmitters and microprocessors being pre-packaged. These components are small in size, and can all be connected on a circuit board at a relatively low cost for packaging in a module. Since the transmission frequency is high, about 930 MHz, the antennas are also small in size, so that both system modules are small in size and slim in thickness.

The small size of the invention vehicle receive/response module allows the module to be placed conveniently inside a vehicle instead of being attached to the outside of the vehicle as is usually required for the currently available search devices.

Another advantage of the invention is that the vehicle receive/response module may include its own rechargeable battery power source, and can thus be portable and moved from one vehicle to another as needed.

From the above description, it is clear that the preferred embodiment of the parked vehicle locator system achieves the objects of the present invention. Alternative embodiments and various modifications may be apparent to those skilled in the art. These alternatives and modifications are considered to be within the spirit and scope of the present invention.

Having described the invention, what is claimed is:

1. A location indicating system for finding and indicating the location direction of a parked vehicle with respect to a system user, said location indicating system comprising (a) a locator module, comprising:

a first case for housing an electrical circuit, said first case being rigid and having a generally rectangular shape with a flat surface face and a parallel back surface; said first case including a visual display means for displaying planar angular direction arrows and elevation direction arrows, and a search initiation switch that are mounted on said face, said first case being sized for holding in a user's hand; and a first circuit for emitting a vehicle search signal and displaying the indicating signal results, said first circuit being mounted in said first case and comprising: a 12 vdc battery as the circuit power source for connection to all circuit components; a first programmable microprocessor; a locator activation switch and circuit connected to said microprocessor; the closing of said switch producing a start signal to said microprocessor; a digital compass, connected to said microprocessor and producing a signal indicating the direction of true north with respect to the forward axis of the held locator module; a digital altimeter, connected to said microprocessor and producing a signal indicating the instant elevation of the locator module; a first means for a radio signal transmitter, connected to said microprocessor; an omni-directional antenna, connected to the output of said transmitter; a second means for a radio signal receiver that is connected to said antenna and having an output connected to said microprocessor; and a display driver circuit, connected to said microprocessor and providing direction indicator activation signals to said visual display means;

said microprocessor incorporating programs to generate and initiate an encoded search activation signal transmission upon demand; to activate and read said digital compass and said altimeter; and to process incoming signals from said receiver and output the resulting direction signals to said display driver circuit for visual display; said transmitter, upon receiving an encoded search activation signal from said microprocessor, generating a high frequency radio signal for transmission by said omni-directional antenna; and, (b) a receive/response module for mounting in a vehicle, said receive/response module comprising:

a second case for housing a second electrical circuit, said second case being rigid and having a generally rectangular shape with elongated opposing, parallel sides, said second case including an externally mounted power connector for connection to a dc power source, and means for attaching said case to the inside surface of a vehicle; and, a second circuit for receiving a vehicle search signal emitted by said locator module, and responding by emitting an estimated AOA (angle-of-arrival with respect to true north) signal to said locator module; said second circuit being mounted in said second case and comprising: an input circuit for connection to said externally mounted power connector, said input circuit providing regulated 12 vdc power for connection to all circuit components; a programmable second microprocessor; a second digital compass, connected to said microprocessor and producing a signal indicating the direction of true north with respect to the forward axis of said receive/response module; a third means for a second transmitter, connected to said second microprocessor; an adaptive antenna array which comprises two independent linear arrays connected to the output of said transmitter; a fourth means for a radio signal receiver that is connected to said adaptive antenna array and having an output connected to said second microprocessor; said second microprocessor incorporating programs to activate and read said second digital compass, and to process incoming received antenna array pattern signals from said receiver, using two independent algorithms to determine and output an encoded estimated AOA (angle-of-arrival with respect to true north) signal to said second transmitter; said second transmitter, upon receiving an encoded estimated AOA signal from said second microprocessor, generating a high frequency, narrowband radio signal for transmission by said adaptive antenna array to said locator module;

said locator module upon receiving said estimated AOA signal from said receive/response module, illuminating said visual display means with directional arrows that indicate the planar angular direction and elevation of the parked vehicle with respect to the forward facing direction of the hand-held locator module.

2. The location indicating system as defined in claim 1, wherein:

said adaptive antenna array comprises two independent linear arrays that are arranged in a two-dimensional planar cross shape, each linear array incorporating a multiplicity of elements that are spaced apart; one said linear array being designated as a vertical array and placed on a vertical axis, and the other said linear array being designated as a horizontal array, said horizontal array having the center of its' axis placed across the center axis of said vertical array and rotated about said center axis to a horizontal axis, plus alpha degrees tilt counter-clockwise from the horizontal axis to provide additional incoming signal discrimination for the horizontal array.

3. The adaptive antenna array in accordance with claim 2, wherein:

said alpha degrees tilt of the horizontal array is selected as being 30 degrees.

4. The location indicating system as defined in claim 1, wherein:

said receive/response module for a vehicle includes a flashing light bulb, said light bulb being connected to said 12 vdc power input by a switch signal output from said second microprocessor, and adapted for mounting externally on top of said vehicle, to visually signal the location of said vehicle when a search activation signal is received by said receive/response module.

5. The location indicating system as defined in claim 1, wherein:

said second circuit in said receive/response module includes a rechargeable 12 vdc battery and a charging circuit that is connected to a power connector that is mounted on said second case; said battery providing an emergency or alternate power source for said second circuit.

* * * * *